US008319152B2

(12) United States Patent
Shalev et al.

(10) Patent No.: US 8,319,152 B2
(45) Date of Patent: Nov. 27, 2012

(54) SHAVER WITH HAIR PREHEATING

(75) Inventors: Pinchas Shalev, Kfar-Saba (IL); Zion Azar, Shoham (IL)

(73) Assignee: Radiancy Inc., Orangeburg, NY (US)

( * ) Notice: Subject to any disclaimer, the term of this patent is extended or adjusted under 35 U.S.C. 154(b) by 352 days.

(21) Appl. No.: 10/533,747

(22) PCT Filed: Jul. 6, 2004

(86) PCT No.: PCT/IL2004/000603
§ 371 (c)(1),
(2), (4) Date: Nov. 9, 2006

(87) PCT Pub. No.: WO2006/003642
PCT Pub. Date: Jan. 12, 2006

(65) Prior Publication Data

US 2007/0084057 A1 Apr. 19, 2007

Related U.S. Application Data

(63) Continuation-in-part of application No. PCT/IL03/00219, filed on Mar. 13, 2003, and a continuation-in-part of application No. PCT/IL03/00220, filed on Mar. 13, 2003, and a continuation-in-part of application No. PCT/IL03/00221, filed on Mar. 13, 2003.

(51) Int. Cl.

| | |
|---|---|
| ***A45D 26/00*** | (2006.01) |
| ***B26B 19/00*** | (2006.01) |
| ***B26B 19/42*** | (2006.01) |
| ***B26B 19/38*** | (2006.01) |

(52) U.S. Cl. ..... 219/222; 219/221; 219/223; 30/140

(58) Field of Classification Search ..... 219/222, 219/223, 225, 227–231, 240, 241, 492; 30/140, 30/34.05, 29.5, 34.1; 132/269, 224–225; 156/251, 515; 606/9, 27–31
See application file for complete search history.

(56) References Cited

U.S. PATENT DOCUMENTS

| | | | | |
|---|---|---|---|---|
| 558,465 | A | | 4/1896 | Bell |
| 589,445 | A | | 9/1897 | Seide |
| 1,054,520 | A | | 2/1913 | Eldridge |
| 1,505,578 | A | * | 8/1924 | Barra ..... 30/140 |
| 1,744,525 | A | | 1/1930 | Chase |
| 1,926,520 | A | | 9/1933 | Fox |
| 2,134,960 | A | | 11/1938 | Testi |
| 2,164,581 | A | | 7/1939 | Ewald |

(Continued)

FOREIGN PATENT DOCUMENTS

| | | |
|---|---|---|
| BE | 748225 | 8/1970 |

(Continued)

OTHER PUBLICATIONS

Bello et al. "Infection and Wound Healing", Wounds: A Compendium of Clinical Research and Practice, 13(4): 127-131, 2001.

(Continued)

*Primary Examiner* — Joseph M Pelham

(57) ABSTRACT

A hair cutting head, for use in a hair cutting apparatus having an elongated heated wire suitable for heating hair growing from a skin surface, and at least one blade placed at one side of the elongated heated wire, the blade being configured to cut the hair which has been heated by the heated wire. The wire is heated to a temperature of at least 50° C.

27 Claims, 7 Drawing Sheets

U.S. PATENT DOCUMENTS

| | | | | |
|---|---|---|---|---|
| 2,231,219 | A | | 2/1941 | Payson |
| 2,324,148 | A | | 7/1943 | Gravin |
| 2,386,409 | A | | 10/1945 | Saffady |
| 2,727,132 | A | | 12/1955 | Hills |
| 3,045,345 | A | | 7/1962 | Bermingham |
| 3,093,724 | A | | 6/1963 | Johnson |
| 3,176,114 | A | | 3/1965 | Kneisley |
| 3,197,612 | A | | 7/1965 | Reich |
| 3,233,322 | A | | 2/1966 | Sparagi et al. |
| 3,365,797 | A | | 1/1968 | Cook |
| 3,421,216 | A | | 1/1969 | Anna |
| 3,474,224 | A | | 10/1969 | Carter |
| 3,521,529 | A | | 7/1970 | Strand |
| 3,524,045 | A | | 8/1970 | Siegel |
| 3,526,750 | A | | 9/1970 | Siegel |
| 3,614,382 | A | | 10/1971 | Politzer |
| 3,902,042 | A | | 8/1975 | Goldfarb et al. |
| 3,925,889 | A | | 12/1975 | Albert |
| 3,934,115 | A | | 1/1976 | Peterson |
| 3,935,974 | A | | 2/1976 | Weyn |
| 4,051,760 | A | | 10/1977 | Glennan |
| 4,130,955 | A | | 12/1978 | Baumgartner et al. |
| 4,155,164 | A | | 5/1979 | White |
| 4,206,555 | A | | 6/1980 | Musto |
| 4,254,324 | A | | 3/1981 | Vrtaric |
| 3,406,966 | A | | 8/1985 | Preusser |
| 4,539,467 | A | | 9/1985 | Wenger |
| 4,608,978 | A | | 9/1986 | Rohr |
| 4,615,347 | A | | 10/1986 | Schooley |
| 4,617,926 | A | | 10/1986 | Sutton |
| 4,745,260 | A | | 5/1988 | Albinger, Jr. et al. |
| 4,819,669 | A | | 4/1989 | Politzer |
| 4,940,466 | A | | 7/1990 | Paduano et al. |
| 5,021,634 | A | | 6/1991 | Santoro et al. |
| 5,064,993 | A | | 11/1991 | Hashimoto |
| 5,065,515 | A | | 11/1991 | Iderosa |
| 5,197,196 | A | | 3/1993 | Imagawa et al. |
| 5,270,520 | A | | 12/1993 | Barzilai et al. |
| 5,309,640 | A | * | 5/1994 | Caron ..... 30/140 |
| 5,317,385 | A | | 5/1994 | Silva et al. |
| 5,394,777 | A | * | 3/1995 | Kozikowski ..... 83/15 |
| 5,554,838 | A | | 9/1996 | Berdich |
| 5,595,568 | A | | 1/1997 | Anderson et al. |
| 5,606,798 | A | | 3/1997 | Kelman |
| 5,633,003 | A | | 5/1997 | Cantor |
| 5,653,025 | A | * | 8/1997 | Cheng et al. ..... 30/41 |
| 5,683,380 | A | | 11/1997 | Eckhouse et al. |
| 5,885,273 | A | | 3/1999 | Eckhouse et al. |
| 5,968,034 | A | | 10/1999 | Fullmer et al. |
| 5,993,440 | A | | 11/1999 | Ghassemi |
| 6,032,365 | A | | 3/2000 | Hodges |
| 6,043,457 | A | | 3/2000 | Hashimoto |
| 6,080,146 | A | | 6/2000 | Altshuler et al. |
| 6,111,222 | A | | 8/2000 | Hattori |
| 6,187,001 | B1 | | 2/2001 | Azar et al. |
| 6,228,074 | B1 | | 5/2001 | Almeida |
| 6,235,015 | B1 | | 5/2001 | Mead, III et al. |
| 6,246,027 | B1 | | 6/2001 | Griffiths |
| 6,307,181 | B1 | | 10/2001 | Hashimoto |
| 6,383,176 | B1 | | 5/2002 | Connors et al. |
| 6,452,501 | B1 | | 9/2002 | Tse et al. |
| 6,481,104 | B1 | | 11/2002 | Parker et al. |
| 6,514,243 | B1 | | 2/2003 | Eckhouse et al. |
| 6,595,985 | B1 | | 7/2003 | Tobinick |
| 6,817,101 | B1 | * | 11/2004 | Bohmer ..... 30/34.05 |
| 6,824,542 | B2 | | 11/2004 | Jay |
| 6,825,445 | B2 | | 11/2004 | Shalev et al. |
| 6,836,966 | B2 | | 1/2005 | Patrick |
| 7,048,746 | B2 | * | 5/2006 | Warden et al. ..... 606/138 |
| 7,202,446 | B2 | | 4/2007 | Shalev et al. |
| 7,699,058 | B1 | | 4/2010 | Jay |
| 2001/0015016 | A1 | | 8/2001 | Pragt |
| 2002/0004986 | A1 | | 1/2002 | Furst et al. |
| 2002/0151881 | A1 | * | 10/2002 | Ringler et al. ..... 606/28 |
| 2003/0037793 | A1 | | 2/2003 | Hwang |
| 2003/0046816 | A1 | | 3/2003 | Kanzer |
| 2004/0045948 | A1 | | 3/2004 | Shalev et al. |
| 2004/0098863 | A1 | | 5/2004 | Shalev et al. |
| 2004/0101447 | A1 | | 5/2004 | Tajima et al. |
| 2005/0127058 | A1 | * | 6/2005 | Shalev et al. ..... 219/223 |
| 2005/0231045 | A1 | | 10/2005 | Oba et al. |
| 2006/0011024 | A1 | | 1/2006 | Shalev et al. |
| 2006/0027554 | A1 | | 2/2006 | Iiashimoto |
| 2006/0070988 | A1 | | 4/2006 | Shalev et al. |
| 2007/0084057 | A1 | | 4/2007 | Shalev et al. |
| 2007/0145031 | A1 | | 6/2007 | Shalev et al. |
| 2007/0179490 | A1 | | 8/2007 | Azar et al. |
| 2009/0178281 | A1 | | 7/2009 | Moore |
| 2009/0205208 | A1 | | 8/2009 | Azar et al. |
| 2009/0211101 | A1 | | 8/2009 | Azar et al. |
| 2010/0198134 | A1 | | 8/2010 | Eckhouse et al. |
| 2011/0314677 | A1 | | 12/2011 | Meier et al. |

FOREIGN PATENT DOCUMENTS

| | | | | |
|---|---|---|---|---|
| DE | 846150 | | | 8/1952 |
| DE | 2343493 | | | 3/1975 |
| DE | 20206181 | | | 8/2002 |
| EP | 0102289 | | | 3/1984 |
| EP | 0201189 | | | 11/1986 |
| EP | 0736308 | | | 10/1996 |
| EP | 0788814 | | | 8/1997 |
| EP | 0888733 | | | 1/1999 |
| EP | 1269881 | | | 1/2003 |
| EP | 1369881 | | | 12/2003 |
| FR | 2532878 | | | 9/1982 |
| FR | 2531655 | | | 2/1984 |
| FR | 2532878 | A | * | 3/1984 |
| FR | 2612381 | | | 9/1988 |
| FR | 2716402 | A1 | * | 8/1995 |
| GB | 658068 | | | 10/1951 |
| IT | 1201364 | | | 1/1989 |
| JP | 01-288291 | | | 11/1989 |
| JP | 03-066387 | | | 3/1991 |
| JP | 05-228019 | | | 9/1993 |
| JP | 62-022643 | | | 8/1994 |
| JP | 08-223783 | | | 8/1996 |
| JP | 10-234461 | | | 9/1998 |
| JP | 10-327928 | | | 12/1998 |
| JP | 11-018827 | | | 1/1999 |
| JP | 11-156800 | | | 6/1999 |
| JP | 2000-217627 | | | 8/2000 |
| JP | 2001-292824 | | | 10/2001 |
| WO | WO 82/03520 | | | 10/1982 |
| WO | WO 92/16338 | | | 10/1992 |
| WO | WO 99/19123 | | | 4/1999 |
| WO | WO 99/34867 | | | 7/1999 |
| WO | WO 03/009976 | | | 2/2003 |
| WO | WO 03/009977 | | | 2/2003 |
| WO | WO 2004/080234 | | | 2/2004 |
| WO | WO 2004/080232 | | | 9/2004 |
| WO | WO 2004/080233 | | | 9/2004 |
| WO | WO 2006/003641 | | | 1/2006 |
| WO | WO 2006/003642 | | | 1/2006 |
| WO | WO 2006/003643 | | | 1/2006 |

OTHER PUBLICATIONS

Rusting "Hair—Why It Grows Why It Stops", Scientific American, p. 55-63, 2001.

Office Action Dated Sep. 5, 2008 From the Patent Office of the People's Republic of China Re.: Application No. 200480043671.0 and Its Translation Into English.

Official Action Dated Aug. 18, 2008 From the US Patent Office Re.: U.S. Appl. No. 10/549,333.

Official Action Dated Jan. 24, 2008 From the US Patent Office Re.: U.S. Appl. No. 10/549,333.

Translation of the Office Action Dated Oct. 6, 2008 From the Intellectual Property Office (IPO) of Taiwan Re.: Application No. 093106706.

Translation of the Office Action Dated Aug. 31, 2007 From the State Intellectual Property Office of the People's Republic of China Re.: Application No. 03826407.2.

Translation of the Office Action Dated Jul. 4, 2008 From the State Intellectual Property Office of the People's Republic of China Re.: Application No. 03826407.2.

Rejection Decision Dated Oct. 24, 2008 From the State Intellectual Property Office of the People's Republic of China Re.: 03826407.2 and Its Translation Into English.
Translation of Notification of Reasons of Rejection Dated Nov. 7, 2008 From the Japanese Patent Office Re.: Application No. 2004-569312.
Examination Report Dated Mar. 13, 2009 From the Instituto Mexicano de la Propriedad Industrial Re.: Application No. MX/a/2007/000270.
Office Action Dated Jan. 4, 2009 From the Israeli Patent Office Re.: Application No. 170824 and Its Translation Into English.
Office Action Dated Feb. 6, 2009 From the State Intellectual Property Office of the People's Republic of China Re.: Application No. 200480043683.3.
Office Action Dated Jan. 9, 2009 From the State Intellectual Property Office of the People's Republic of China Re.: Application No. 2004800436829 and Its Translation Into English.
Decision of the Intellectual Property Office and the Search Report Dated Dec. 4, 2008 From the Intellectual Property Office of Taiwan R.O.C. Re.: Application No. 093106706.
Japanese Official Action Dated Oct. 6, 2008 From Japan Re.: Application No. 2003-515356.
Notice of Allowance Dated Nov. 30, 2006 From the US Patent and Trademark Office Re.: U.S. Appl. No. 10/530,501.
Office Action Dated Sep. 5, 2008 From the State Intellectual Property Office of the People's Republic of China Re.: Application No. 200480043671.0 and Its Translation Into English.
Translation of the Notification of the Report of the Examiner Dated Jan. 2, 2009 From the Chilean Patent Department Re.: Application No. 1690-2005.
Official Action Dated May 8, 2006 From the US Patent and Trademark Office Re.: U.S. Appl. No. 10/530,501.
Notification of Reason of Rejection Dated Jul. 4, 2008 From the Japanese Patent Office Re.: Application No. 2003-515356 and Its Translation Into English.
Translation of the Official Notification of the IPO Including Search Report Dated Dec. 10, 2007 From the Intellectual Property Office (IPO) of Taiwan R.O.C. Re.: Application No. 093106706.
Official Action Dated Jun. 25, 2007 From the US Patent and Trademark Office Re.: U.S. Appl. No. 10/535,536.
Examiner's Report Dated Sep. 3, 2009 From the Australian Government, IP Australia Re.: Application No. 2004321179.
Office Action Dated Aug. 28, 2009 From the State Intellectual Property Office of the People's Republic of China Re.: Application No. 200480043683.3 and Its Translation Into English.
Translation of Office Action Dated Jul. 26, 2011 From the Korean Intellectual Property Office Re. Application No. 10-2007-7002544.
Response Dated Sep. 7, 2011 to Office Action Dated Jul. 26, 2011 From the Korean Intellectual Property Office Re. Application No. 10-2007-7002544.
Response Dated May 4, 2010 to Examiner's Report of Sep. 3, 2009 From the Australian Government, IP Australia Re.: Application No. 2004321179.
Translation of Notification of Reasons of Rejection Dated Mar. 26, 2010 From the Japanese Patent Office Re.: Application No. 2007-519971.
Communication Pursuant to Article 96(2) Dated Oct. 18, 2007 From the European Patent Office Re.: Application No. 04744943.4.
Communication Pursuant to Article 96(2) EPC Dated Oct. 18, 2007 From the European Patent Office Re.: Application No. 04744944.2.
International Preliminary Report on Patentability Dated Jan. 18, 2007 From the International Bureau of WIPO Re.: Application No. PCT/IL2004/000604.
Official Action Dated Jan. 2, 2008 From the US Patent and Trademark Office Re.: U.S. Appl. No. 10/535,536.
Official Action Dated Aug. 18, 2008 From the US Patent and Trademark Office Re.: U.S. Appl. No. 10/549,333.
International Preliminary Report on Patentability Dated Jan. 18, 2007 From the International Bureau of WIPO Re.: Application No. PCT/IL2004/00604.
Office Action Dated Nov. 11, 2009 From the Israel Patent Office Re.: Application No. 180463 and Its Translation Into English.
Office Action Dated Nov. 22, 2009 From the Israel Patent Office Re.: Application No. 180465 and Its Translation Into English.
Official Action Dated Apr. 14, 2009 From the US Patent and Trademark Office Re.: U.S. Appl. No. 10/549,333.
Response Dated Feb. 2, 2010 to Office Action of Nov. 22, 2009 From the Israel Patent Office Re.: Application No. 180463.
Response Dated Jan. 24, 2010 to the Notification of the Report of the Examiner of Dec. 9, 2009 From the Propriedad Industrial e Intellectual Oficina de Chile Re.: Application No. 1690-2005.
Translation of the Notification of the Report of the Examiner Dated Dec. 9, 2009 From the Propriedad Industrial e Intellectual Oficina de Chile Re.: Application No. 1690-2005.
Written Opinion Dated Feb. 16, 2005 From the International Preliminary Examining Authority Re.: Application No. PCT/IL03/00220.
Written Opinion Dated Mar. 17, 2005 From the International Searching Authority Re.: Application No. PCT/IL2004/000604.
Response Dated May 16, 2011 to Requisition by the Examiner of Jan. 20, 2011 From the Canadian Intellectual Property Office Re. Application No. 2,572,550.
Translation of Office Action Dated Aug. 23, 2010 From the IPO of Taiwan Re. Application No. 094122868.
Translation of Office Action and Search Report Dated Sep. 7, 2011 From the Intellectual Property Office of Taiwan (ROC) Re. Application No. 094122871.
Official Action Dated Jun. 21, 2010 From the US Patent and Trademark Office Re.: U.S. Appl. No. 10/535,536.
Response Dated Jun. 8, 2010 to Rejection of Mar. 26, 2010 From the Japanese Patent Office Re.: Application No. 2007-519971.
Technical Report Dated Nov. 24, 2011 From the Instituto Nacional de Propriedad Industrial de la Republica de Chile Re.: Application No. 1690-2005 and Its Summary in English.
Response Dated Nov. 20, 2011 to Office Action and Search Report of Sep. 7, 2011 From the Intellectual Property Office of Taiwan (ROC) Re. Application No. 094122871.
Official Action Dated Aug. 15, 2012 From the US Patent and Trademark Office Re. U.S. Appl. No. 11/571,753.
Official Action Dated Aug. 15, 2012 From the US Patent and Trademark Office Re. U.S. Appl. No. 11/571,763.

* cited by examiner

SHAVER WITH HAIR PREHEATING

RELATED APPLICATIONS

The present application is a U.S. National Stage application of PCT application No. PCT/IL2004/000603, Shaver with Hair Preheating, filed on Jul. 6, 2004. The present application is also a continuation-in-part of PCT/IL03/00219, PCT/IL03/00220, and PCT/IL03/00221 all filed on Mar. 13, 2003 the disclosures of which are incorporated herein by reference.

FIELD OF THE INVENTION

The present invention relates to preheating hair prior to removal with a cutting element.

BACKGROUND OF THE INVENTION

The removal of unwanted hair from the body can be accomplished with mechanized means, for example razors, tweezers or wax, all of which are uncomfortable to use, irritate the skin and/or cause damage to the skin.

The use of heated wires or other structures to cut hair from a skin surface has been proposed. However, a heat generator that generates heat of a sufficient magnitude to cut hair and is offset from the skin to prevent skin damage, often leaves behind unwanted stubble.

In Peterson, U.S. Pat. No. 3,934,115, parallel metal strips on the upper side of ceramic facing that contacts the skin, are used to cut hair. Hills, in U.S. Pat. No. 2,727,132 and P. Massimo in IT 1201364, use a continuously heated element to burn hair. P. M. Bell in U.S. Pat. No. 558,465, D. Seide in U.S. Pat. No. 0,589,445, G. S. Hills in U.S. Pat. No. 2,727,132, G. L. Johnson in U.S. Pat. No. 3,093,724, Hashimoto in U.S. Pat. Nos. 5,064,993 and 6,307,181 B1, F. Solvinto in FR 2531655 and EP 0201189, and E. Michit in 2612381, use a continuously heated wire to burn hair. J. F. Carter in U.S. Pat. No. 3,474,224, provides a circular comb device for burning nose hairs. These references do not appear to provide a means of reducing the hairs to the level of the skin.

Vrtaric, in U.S. Pat. No. 4,254,324, provides a heat hair cutting system that is applied only to the tips of the hair to remove the split ends.

Iderosa, in U.S. Pat. No. 5,065,515, describes a heating element that preheats hair before cutting it with a blade coupled to the heating element. However, since the heating element is permanently in contact with the skin, it is believed that its temperature is limited to a temperature which does not damage the skin, for continuous exposure and which is not uncomfortable for the user.

The present applicants have disclosed a heat-generating system for cutting hair in PCT publications WO 03/009977 and WO 03/009976. The disclosures of these applications are incorporated herein in their entirety by reference. These applications describe methods and devices in which a wire providing pulsed or non-pulsed heat is used to cut hair. As used herein, a heat-generating wire refers to one or more of: metal wires, ribbons or any other type of heat-generating elements capable of generating heat of sufficient magnitude and/or duration to cut hair from an area of skin. In general, all of the configurations of wires, etc. disclosed in either of the above referenced applications are applicable to the present invention. In addition, the structures and methods described herein are usable in or in conjunction with the structures disclosed therein.

In the above referenced PCT applications, the hair is severed close to the skin by heating the hair. This severing of the hair may also destroy at least a portion of the hair below the skin. As used herein the term "cut" is used to describe this type of severing or shaving of the hair.

SUMMARY OF THE INVENTION

An aspect of some embodiments of the invention relates to a structure adapted for cutting hair with a removable cutting head. The removable cutting head comprises a wire that generates heat that is sufficient to cut hair, optionally with the aid of a blade. In an exemplary embodiment of the invention, the removable cutting head is positioned in the structure between two supports that position the surface of the skin with respect to the wire.

Optionally, one of the supports is adapted to sense motion of the structure across the skin from which the hair grows, for example using a movable roller, an optical motion detector or an inertial motion detector. In some embodiments of the invention, the cutting head is activated responsive to the motion. In some embodiments of the invention, the cutting head is positioned to contact the skin and is activated to cut hair by heating the wire. Alternatively, the cutting head is normally positioned below the supports (out of contact with the skin) and when activated, is moved to the level of the supports to interface the skin.

In some embodiments of the invention, the wire is heated only when motion is detected by the support sensor, in order to prevent the skin from being burnt by contact with the wire for a long time. Alternatively, the wire is distanced from the skin when not in motion across the skin. In the latter case, the heating need not be controlled by the sensing of motion.

An aspect of some embodiments of the invention relates to a removable cutting head for cutting hair by heat that comprises a debris removal element, such as a blunt scraper, to remove debris resulting from the cutting process. In an exemplary embodiment of the invention, the cutting head burns hairs near their roots leaving carbonized residue in the hair pores and on the skin surface. The scraper, optionally attached to the cutting head, scrapes away the carbonized residue and any other debris (e.g. small hairs) produced during the cutting process.

An aspect of some embodiments of the invention relates to a removable cutting head for cutting hair by heat, which additionally comprises a blade mounted on one side of the cutting head. In some embodiments of the invention, the wire in the cutting head is not hot enough to cut hair, or is not hot enough to cut hair with a thickness above a certain value. In this case, the blade cuts the hair. However, heating of the hair makes the cutting action faster and smoother even without shaving cream or the like. Optionally, the blade mounted on the cutting head complements the heated wire in cutting hair, leading to a smoother result. In some embodiments of the invention, the heated wire softens the hair before it is cut, in order to allow use of a duller blade. In an embodiment of the invention, the wire is heated to a temperature above 50° C., optionally above 100° C., 150° C., 500° C. or 600° C. While this aspect of the invention is usable with wires that are not hot enough to burn and cut the hair, it is also usable with hotter wires which do cut some or all the hairs and is then used as a back-up to avoid multiple passes for cutting uncut or partially cut hairs.

There is thus provided, in accordance with an embodiment of the invention, a hair cutting head, for use in a hair cutting device comprising:

an elongated heated wire suitable for heating hair growing from a skin surface; and at least one blade, placed at one side of the elongated heated wire, the at least one blade being situated and configured to cut the hair which has been heated by the heated wire, wherein the wire is heated to a temperature of at least 50° C.

Optionally, the head comprises a row of skin depressing elements on at least one side of the elongated heated wire and optionally both sides of the elongated heated wire.

In an embodiment of the invention, the wire has a minimum dimension of between 10 to 1000 micrometers.

There is further provided, in accordance with an embodiment of the invention, a hair cutting comprising:

a hair cutting head according to the invention.

Optionally, said wire is heated only when said cutting head comes in contact with a skin surface.

Optionally, the wire is heated to a temperature higher than 100° C., 150° C., 250° C., 350° C., 500° C. or 700° C.

In an embodiment of the invention the wire is heated to a temperature high enough so that it cuts at least some of the hair before the hair comes into contact with said blade, when the heated wire and blade are drawn across the skin.

There is further provided, in accordance with an embodiment of the invention, a method of cutting hair growing from the skin, comprising:

heating a portion of a hair attached to the skin of a person to a temperature above 50° C.

cutting the hair at the heated portion with a blade.

In an embodiment of the invention, the hair is heated with a hot wire.

Optionally, the wire is heated to a temperature higher than 100° C., 150° C., 250° C., 350° C., 500° C. or 700° C.

In an embodiment of the invention, the method includes juxtaposing the wire and the blade in a generally parallel configuration.

Optionally, the method includes first moving the heated wire and then the blade across the skin. Optionally, at least some of the hair growing from the skin is not cut by the wire as it passes across the skin. Optionally, the wire is not hot enough to cut the hair.

BRIEF DESCRIPTION OF THE DRAWINGS

Exemplary non-limiting embodiments of the invention described in the following description, read with reference to the figures attached hereto. In the figures, identical and similar structures, elements or parts thereof that appear in more than one figure are generally labeled with the same or similar references in the figures in which they appear. Dimensions of components and features shown in the figures are chosen primarily for convenience and clarity of presentation and are not necessarily to scale. The attached figures are.

DESCRIPTION OF EXEMPLARY EMBODIMENTS

Figure 1A:
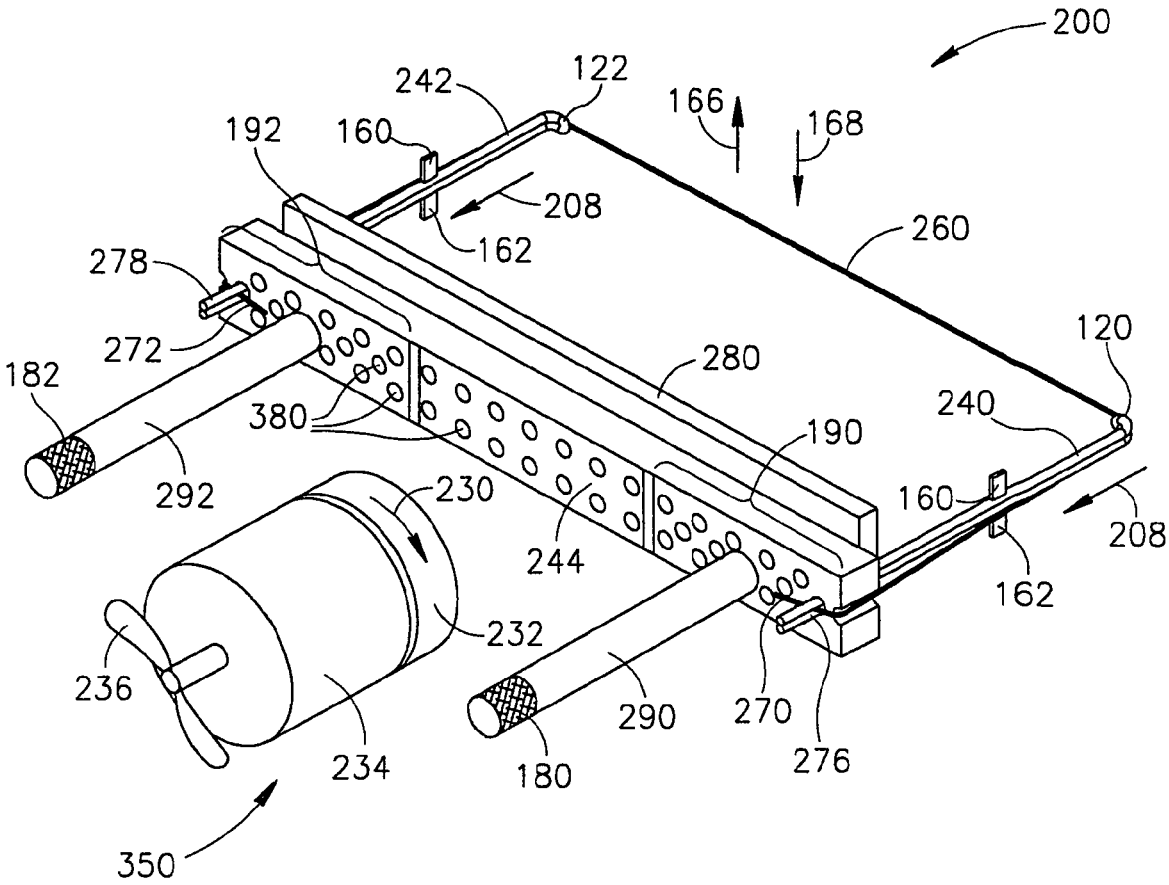
FIG. 1A is a schematic diagram of a structure supporting a heat-generating wire adapted for cutting hair, in accordance with an exemplary embodiment of the invention.

FIG. 1A is a simplified schematic diagram of a heat-generating wire 260 suspended on a frame 200, comprising two posts 240 and 242, in accordance with an exemplary embodiment of the invention. In an exemplary embodiment, posts 240 and 242 comprise wire guideways 120 and 122. Heat-generating wire 260 is optionally centered in guideways 120 and/or 122.

In an exemplary embodiment, posts 240 and 242 are held in position by a strut 244, for example substantially perpendicular to posts 240 and 242. Heat-generating wire 260, for example, is attached at wire ends 270 and 272 to posts 240 and/or 242.

In an exemplary embodiment, a conduction post 290 is electrically conductive and is attached to an electrically conductive area 190 while a conduction post 292 is electrically conductive and is attached to an electrically conductive area 192. Further, tension-providing posts 240 and 242 are electrically conductive and connected to conductive areas 190 and 192 respectively so that power provided through posts 290 and 292 causes wire 260 to generate heat.

In an exemplary embodiment, one or both of tension posts 240 and 242 are manufactured from a springy electrically conductive material so that when properly positioned, they serve to keep heat-generating wire 260 taut during motion across a skin surface. Optionally, posts 240 and/or 242 are relatively flexible so they bend when subjected to a force pushing them towards each other. Optionally, posts 240 and/or 242 are relatively inflexible so they do not bend when subjected to a force pushing them perpendicular to the axis of wire 260.

In an exemplary embodiment, tensioning of wire 260 during manufacture is accomplished, for example, in the following manner, when one or both of the posts are springy.

With the wire placed in guides 120 and 122, wire ends 270 and/or 272 are pulled in a direction 208, with sufficient force and/or at an appropriate angle, with respect to (horizontal) wire 260, to cause posts 240 and 242 to bend toward each. Wire 260 is then attached to posts 240 and/or 242, for example at points 276 and 278 respectively, using solder, electrically conductive glue (such as conductive epoxy), brazing, laser brazing and/or other connection means known in the art. Mechanical connection such as clamping can also be used. Optionally the clamp is copper or gold coated to provide a slightly conforming and highly conductive mechanical electrical connection. It should be noted that posts guideways 120 and/or 122 may be continually bent toward each other by the tension of wire 260. After attachment to the posts, free ends of the wires may be removed.

A similar method may be used if only one post is springy (or even if both are springy). In this case, wire 260 is optionally permanently attached to the inflexible post (or optionally to the frame), before or after tensioning. Then the other end of the wire is tensioned as aforesaid and then attached to the frame or post on which it is mounted. Optionally, especially when the wire is pre-attached to one of the posts, that post does not need a guide.

Optionally, additional tension to wire 260 is provided by one or more coiled springs between posts 240 and/or 242 and wire 260.

Figure 4:
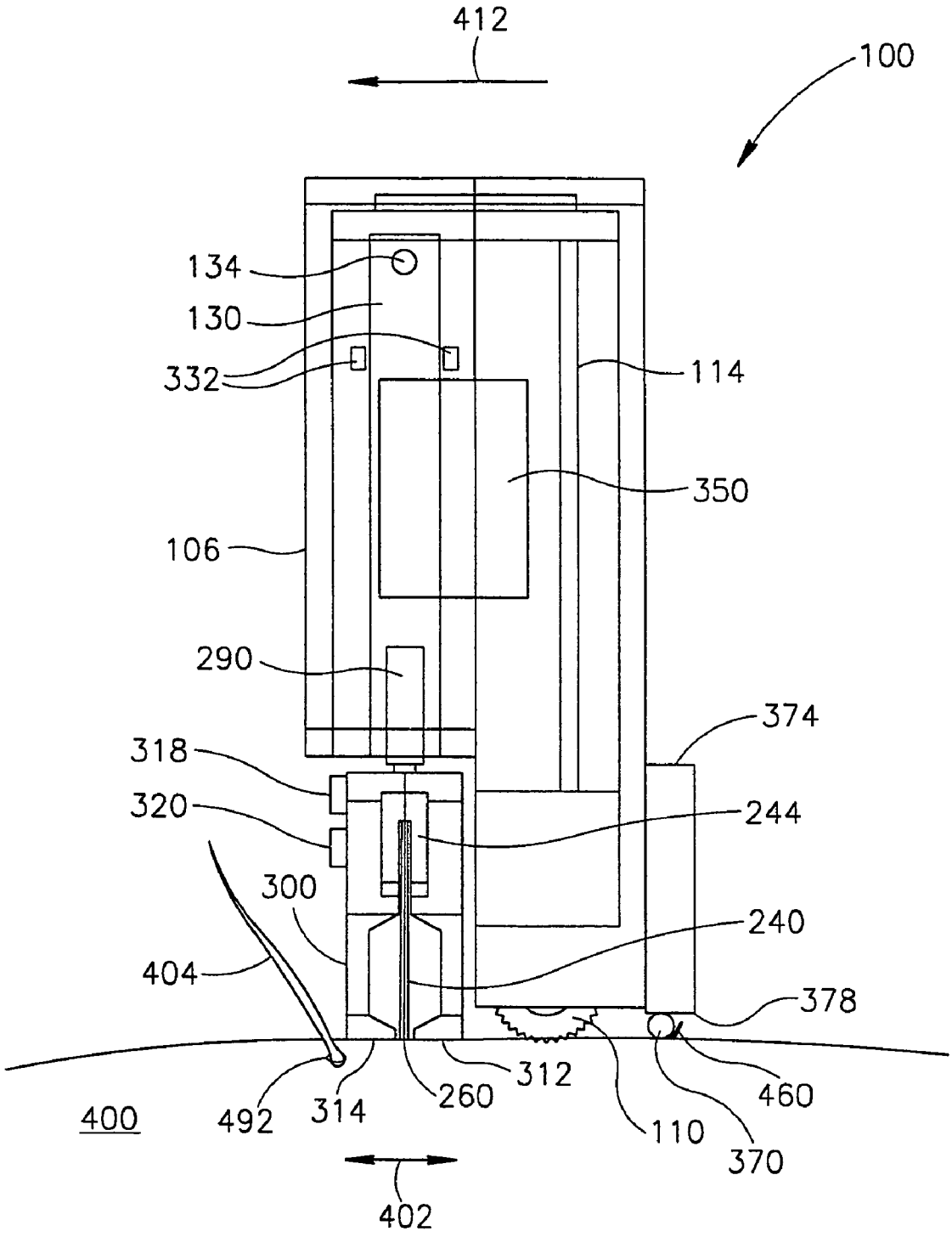
FIG. 4 is a side cross-section of the vibrating hair cutting unit of FIG. 3, shown while cutting a hair, in accordance with an exemplary embodiment of the invention.

Tensioned wire 260 will remain in tension even in the presence of longitudinal expansion that occurs due to heating of wire 260 and/or due to pressure as wire 260 moves in a direction 402 against a hair 404 (FIG. 4).

One method of pulling wire ends 270 and/or 272 in direction 208 is by attaching wire ends 270 and/or 272 to one or more tension-providing wheels (not shown), positioned, for example on strut 244. By rotating the one or more wheels, wire ends 270 and 272 are pulled in direction 208 to tension wire 260. Other methods for pulling wire 260 in direction 208 are known in the art and include, for example, attaching a spring mechanism and/or pneumatic tensioning device to wire ends 270 and/or 272.

In an exemplary embodiment, conductive post 290 fits into a socket 180 and conductive post 292 fits into a socket 182. A friction fit between sockets 180 and 182 and posts 290 and 292 is provided, for example to allow easy removal of frame 200 from sockets 180 and 182 for replacement of the entire frame or for cleaning and/or repair of wire 260. Sockets 180 and 182, for example, are conductive and capable of transmitting power from a power source, thereby providing electrical current to heat-generating wire 260 via posts 290 and 292, connection area 190 and 192 and tension posts 240 and 242. It is generally envisioned that the wire, posts and strut mechanism will be replaced when the wire breaks.

In an exemplary embodiment, post supports 160 are positioned against posts 240 and 242 to prevent undue motion in a direction 168. Alternatively or additionally, posts supports 162 are positioned against posts 240 and 242 to prevent undue motion in a direction 166. This assures that motion applied to frame 200 results in desired motion of the wire.

Figure 1B:
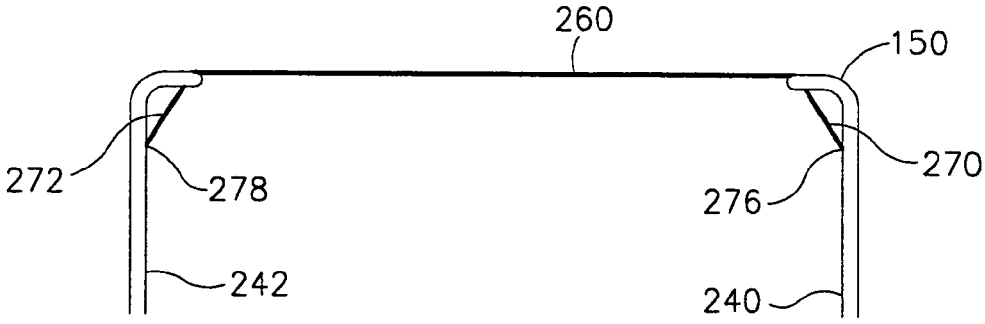
FIG. 1B is a schematic diagram of an alternative structure of FIG. 1A, in accordance with an exemplary embodiment of the invention.

FIG. 1B is a schematic diagram of an alternative structure of FIG. 1A, in accordance with an exemplary embodiment of the invention. In this embodiment, wire 260 passes through rings 150 and 152 in posts 240 and 242 prior to tensioning and attachment to the posts.

Figure 2:
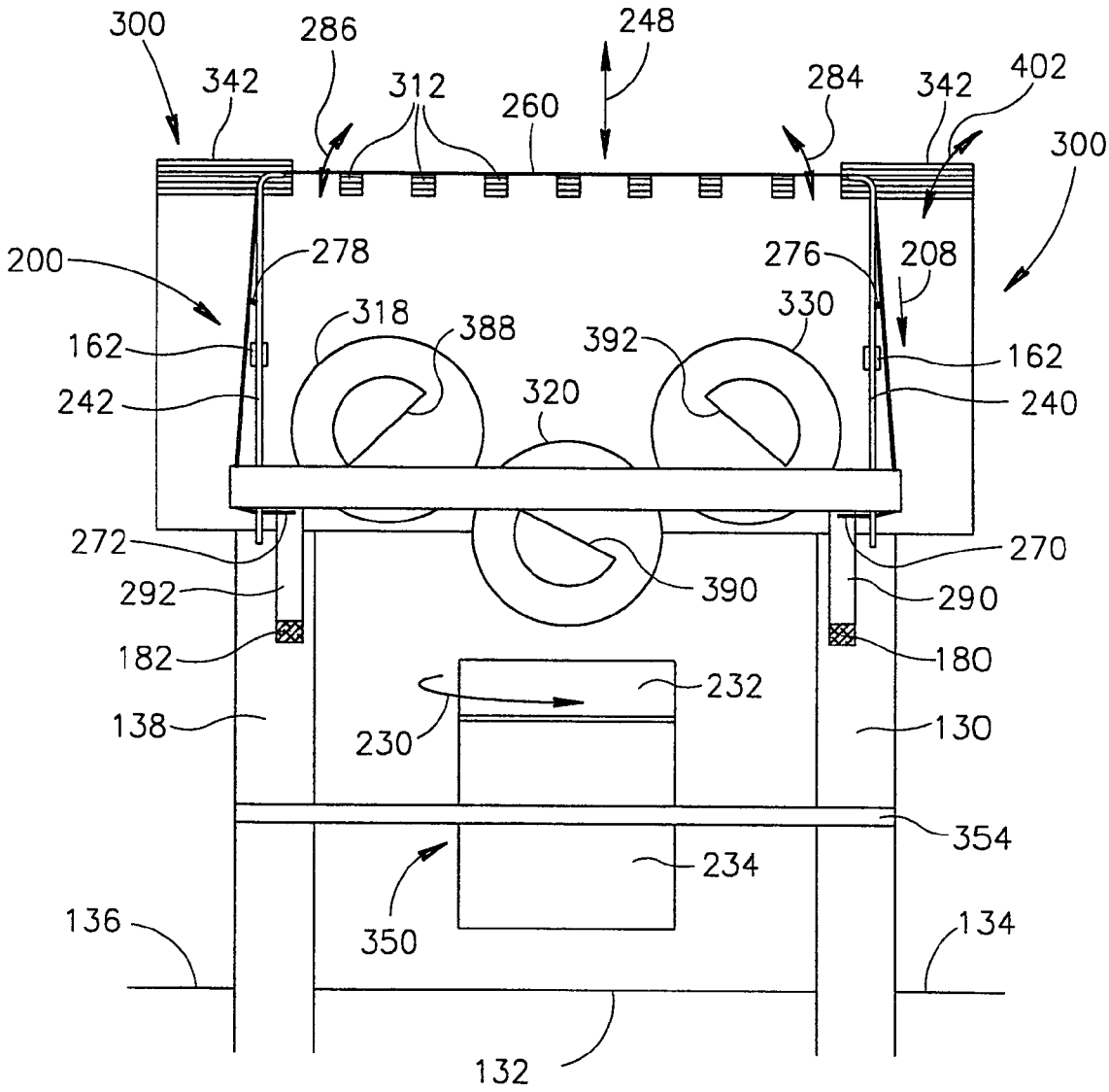
FIG. 2 is a schematic diagram of the structure of FIG. 1A including position adjusters, in accordance with an exemplary embodiment of the invention.

FIG. 2 is a schematic diagram of heat-generating wire 260 on frame 200 of FIG. 1A, mounted in vibrating compartment 300 that projects from vibrator posts 130 and 138. In an exemplary embodiment, a vibrator 350 connected to posts 130 and 138, comprises a motor 234 having an off-center weight 232 that causes vibration of vibrator 350 as motor 234 revolves in a direction 230. Alternatively or additionally, vibrator 350 is connected to posts 130 and 138 with a transverse connector 354.

An optional cross pin 132 passes through vibrator posts 130 and 138, allowing their movement around pin 132. As vibrator 350 vibrates, it imparts vibration to vibrator posts 130 and 138, thereby causing heat-generating wire 260 and/or compartment 300 to cyclically move in directions 402.

In cutting hair 404 (FIG. 4), vibration of wire 260, frame 200 and/or compartment 300 facilitates heat-generating wire 260 to make multiple passes over hair 404 while held against a given area of skin 400. Multiple passes of wire 260 increase the cutting efficiency of heat-generating wire 260 during each period it contacts area of skin 400 (i.e., as it is moved, by the user, across the skin surface). The excursion of the wire is, for example, between 0.05 and 2 mm, optionally between 0.3 and 1 mm.

In an exemplary embodiment, vibrating compartment 300, for example comprises a snap-together structure and/or is removably attached to vibrator posts 130 and 138 so that it can be removed for cleaning and/or to allow removal of frame 200 from sockets 180 and 182.

Figure 3:
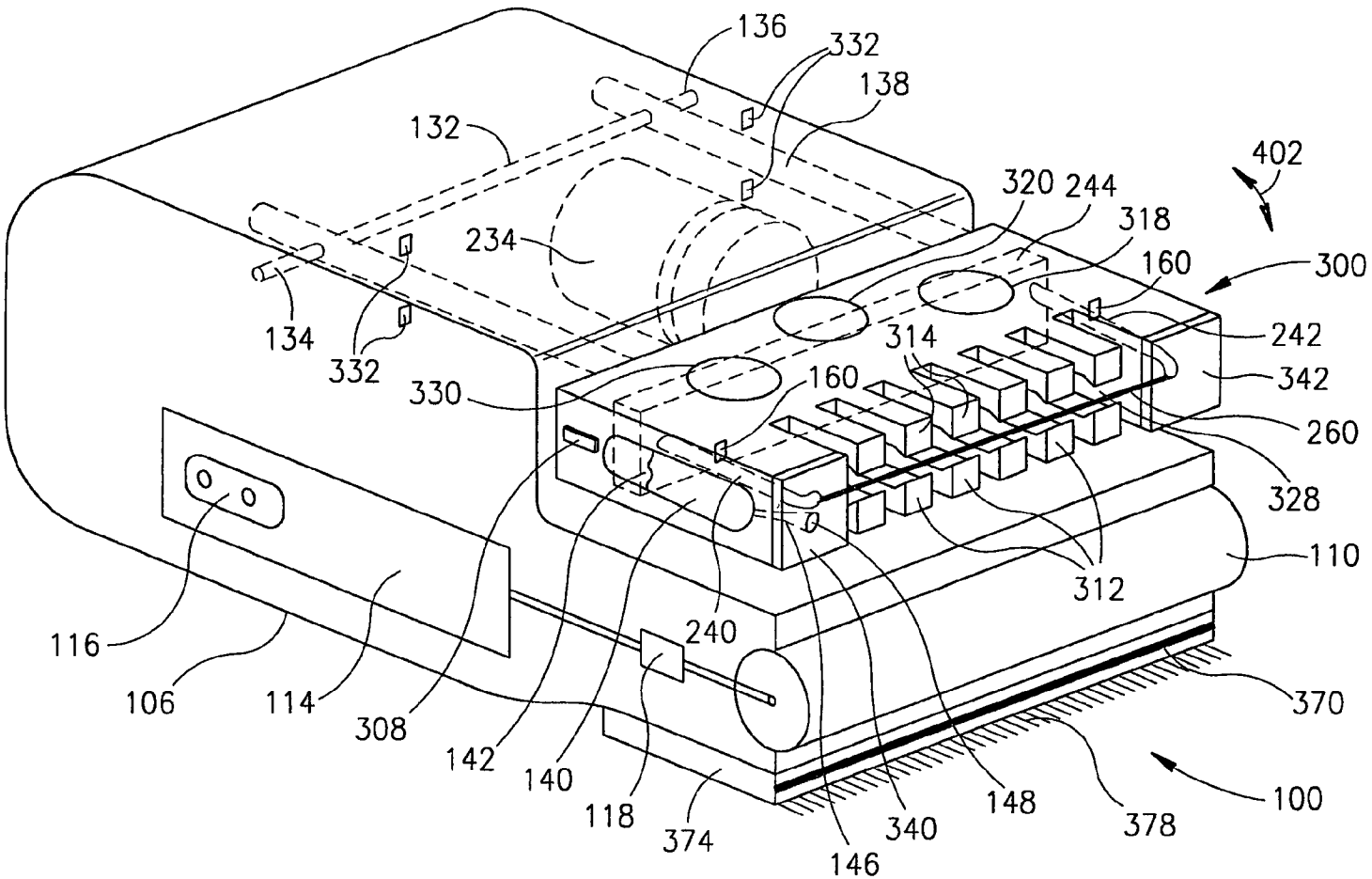
FIG. 3 is a partly sectioned isometric view of a vibrating hair cutting unit, in accordance with an exemplary embodiment of the invention.

As shown more clearly in FIG. 3, in an exemplary embodiment, compartment 300 comprises a row of skin-depressing elements 312. Skin-depressing elements 312 serve to depress and/or tighten area of skin 400 (FIG. 4), allowing heat-generating wire 260 to cut hair 404 without sinking into skin 400 and possibly dissipating its heat so that it cuts less efficiently and/or burns skin 400.

In an exemplary embodiment of the invention, two rows of skin-depressing elements are provided on either side of heat-generating wire 260. Rows of skin depressors are shown in the PCT publications described above, for example, posts or the like. However, the skin depressors shown in the present embodiments differ from those shown in that they comprise elongate elements that whose long axis points generally toward the wire. The present inventors have found that the elongate elements shown herein provide for smoother and more comfortable travel of the shaver along the skin. Other configurations of skin-depressing elements 312, for example, comprising skin-depressing elements 312 at varied heights, angles, and/or planes with respect to skin 400 (FIG. 4), wire 260 and/or compartment 300, are also contemplated in exemplary embodiments of the invention. In preferred embodiments of the invention the long axis of the elongate elements is parallel to the plane of the opening (and thus of the skin) or are at a small angle (5, 10, 15 or 20 degrees) with respect to the plane.

Alternatively or additionally, post protectors 340 and 342 extend beyond posts 240 and 242 and/or skin-tensing and depressing elements 312. In an exemplary embodiment, post protectors 340 and 342 prevent the heat and/or vibrations from posts 240 and 242 from damaging skin 400 (FIG. 4) or vice-versa, by offsetting the proximate area of skin 400 proximal away from posts 240 and 242.

In an exemplary embodiment, wheels 318, 320 and/or 330 are juxtaposed against strut 244 and are rotatable so that flats 388, 390 and 392 respectively adjust the position of strut 244. Positional adjustments of strut 244 affect the position of wire 260 with respect to skin-depressing elements 312 and hence against area of skin 400. By rotating wheels 318, 320 and/or 330, an operator, for example, controls the closeness of heat-generating wire 260 to skin-depressing elements 312, adjusting the position of wire 260 in a direction 248. Alternatively or additionally, the operator adjusts the angle of wire 260 to skin-depressing elements 312, for example in directions 284 and/or 286.

Using wheels 318, 320 and/or 330 an operator can optimally position an angle of the wire with respect to the plane of the ends of depressors 312 (or the opening, if rows of depressors are not used).

FIG. 3 is a cross-section of a vibrating hair cutting unit 100 having vibrating compartment 300 and a relatively non-vibrating structure 106, with wire 260 positioned within a gap 328. Optionally, skin-depressing elements 312 are elongate elements, positioned on one side of wire 260, pointing toward gap 328. As indicated above, a row of skin depressing elements 314 may comprise elongate elements on the opposite side of wire 260 gap that point toward gap 328. Optionally, post supports 160 and 162 are positioned against posts 240 and 242 to prevent wire 260 from contacting skin depressing elements 312 and/or 314.

Structure 106, for example, comprises a mechanical motion detector wheel or roller 110 that rotates along a surface, for example area of skin 400 (FIG. 4) and signals a controller 118 that unit 100 is moving in relation to skin 400. In an exemplary embodiment, controller 118 turns vibrator 350 on or off in response to movement, thereby causing vibrator 350 to selectively provide vibrations.

Optionally, motion detector wheel 110 switches vibrator 350 on when unit 100 moves above a minimum speed in relation to skin 400 and switches vibrator 350 off when unit 100 moves below the minimum speed. In exemplary embodiments of the invention, the minimum speed is between 0.2 to 1 cm/second optionally about 0.5 cm/sec. In some embodiments of the invention, the motion detector also indicates when the speed is above a value to cause proper hair removal. In general, this speed is above 1-3 cm/sec. However, this value may vary depending on the diameter and temperature of the wire. Alternatively or additionally, mechanical motion detector 110 comprises an optical motion detector that directs controller 118 to switch vibrator 350 on or off. Optionally, in addition to controlling vibrations, motion detector 110 functions to switch heat generated by wire 260 on or off in response to motion of unit 100 on skin 400. Optionally, the system includes a visual indication of whether the heat and/or vibration are activated, as for example a light. In an embodiment of the invention, the light is green when the velocity is in a desired range and red when it is outside this range.

In an exemplary embodiment, a battery 114, for example, provides power to vibrator 350 and/or wire 260. Optionally, battery 114 is rechargeable and, for example, linked by a power input 116 to an external power source, for example a power converter and/or an AC electric power receptacle (not shown). Alternatively or additionally, power input 116 is directly connected to wire 260 and/or vibrator 350 without battery 114 intervening and wire 260 is powered, for example, by AC current.

For clarity of presentation, in these embodiments, connections, for example between tension posts 240 and 242, and/or vibrator 350, and battery 114, are not shown. However in an exemplary embodiment, a simple arrangement of electrical connectors is used to electrify heat-generating wire 260, vibrator 350 and/or other components associated with unit 100.

In an exemplary embodiment, cross pin 132 has end pins 134 and 136 that attach to structure 106, allowing vibrating compartment 300 to vibrate on posts 130 and 138 in relation to structure 106. One or more movement limiters 332 that abut post 130 and/or 138 to limit excursion of posts 130 and 138 during vibration of compartment 300 optionally project from housing 106. In an exemplary embodiment, movement limiters 332 comprise compressible material, for example a silicone. In an alternative exemplary embodiment, frame 200 is connected directly to vibrator 350 and compartment 300 and structure 106 remain stationary while heat-generating wire 260 vibrates in relation to skin 400.

In an exemplary embodiment, compartment 300 comprises a container 140 adapted for receiving a fluid and/or solid deodorant 142. Container 140, for example, is joined to a passage 146 having a venturi opening 148. Deodorant 142 atomizes as compartment 300 vibrates and is distributed through venturi opening 148 to the area around wire 260 and/or to skin 400.

Alternatively or additionally, deodorant 142 vaporizes in response to heat provided by heat-generating wire 260. Alternatively or additionally a cover 310 is provided on passage 146 and a user-operated trigger 308 is provided on structure 106 that opens cover 310 to release vapors and/or aerosol from deodorant 142.

No matter what type of dispensation means is used, though, as deodorant 142 atomizes and/or vaporizes, it passes through communication passage 146 to the general area of heat-generating wire 260 and skin 400, thereby masking and/or neutralizing odors generated during cutting of hair. The deodorant (which can be a perfume that masks the smell of the burnt hair), can be provided in different popular scents In still another alternative exemplary embodiment shown in FIG. 1A, a smoke and/or odor-removing filter 280 is located over ventilation holes 380 in strut 244. A rotatable ventilator prop blade 236 (or other pumping mechanism) rotates to cause odors to be drawn through filter 280. A ventilator passage connecting an input of filter 280 to holes 380 may be provided to allow flow of the air containing the burnt odor to filter 280

Optionally, filter 280 comprises a porous material that absorbs a deodorant, for example a liquid deodorant and an operator places liquid deodorant on at least one area of filter 280. As odors pass over filter 280, they are neutralized and/or replaced with a pleasant fragrance. Optionally, odor-removing filter 280 is located in or adjacent a receptacle 374 that additionally collects cut hair 460 (FIG. 3).

Optionally, blade 236 is activated together with the heat and/or vibration. Optionally, it is deactivated at the same time as one or both of these elements or operates for a somewhat longer time to provide additional odor removal.

FIG. 4 is schematic cross-sectional view of vibrating hair cutting unit 100 cutting hair 404 that is growing from area of skin 400, in accordance with an exemplary embodiment of the invention.

In an exemplary embodiment, an electrostatic outcropping 370 is incorporated into unit 100, for example near motion detector wheel 110 and electrostatically attracts a cut hair 460 cut by heat-generating wire 260. Electrostatic outcropping 370, for example, of Teflon material will self charge, by friction with the skin, to an extent suitable for attracting the hair. Other charging means and materials can also be used.

Optionally, hair collection receptacle 374 is juxtaposed near outcropping 370 to collect cut hair 460 that accumulates on outcropping 370. Optionally, receptacle 374 has a collection aid 378, comprising a comb or brush, that brings cut hair 460 in proximity of outcropping 370.

In an exemplary embodiment, wire 260 is manufactured from Kantaal D, (an alloy of nickel chromium and other metals manufactured by Kantaal Group). Alternative materials for wire 260 include Nichrome, other wire resistance materials or other alloys suitable for high temperature operation. For lower temperatures other spring steel (SS) alloys are suitable. For higher temperatures platinum tungsten wire (such as PtW wire manufactured by Johnson Matthey (UK), Precious Metals Division or Goodfellow (UK)) may be used. Other high temperature wires materials such as pure platinum and platinum/iridium alloy can also be used. However, such wires are very flexible.

In an exemplary embodiment, the current through wire 260 is 0.5 A, though it may vary, depending on the dimensions and/or materials comprising wire 260. In order to cut efficiently, wire 260, for example, reaches a peak temperature of between 700 and 1200° C., when wire 260 is held against hair 404 for 0.1-100 milliseconds, optionally 1-10 milliseconds, depending on the mass and temperature of the wire used. In some embodiments of the invention, the temperature of the wire is even higher than 1200° C.

Lower temperatures, for example 500° C., can be used to cut hair 404 when wire 260 is held against hair for longer periods of times, for example, 50-150 milliseconds. Higher temperatures, for example 1000° C., can be used to cut hair 404 when wire 260 is held against hair 404 for shorter periods of time, for example, 5-15 milliseconds.

Battery 114, for example, produces between 3 and 30 volts and between 0.030 and 5 amperes, depending on the dimensions of wire 260.

In exemplary embodiments, wire 260 has a circular cross section with a diameter of 0.01-0.25 millimeters. Alternatively, wire 260 has a diameter of above 0.25 millimeters (e.g between 0.25 mm-0.5 mm or even up to 1 mm), when manufactured from a less flexible and/or weaker material and below 0.25 millimeters when manufactured from a more flexible and/or stronger and/or higher temperature material.

In some embodiments of the invention, wire 260 is shaped as a ribbon with a rectangular cross section or another geometrical shape, instead of a circular cross section as described above. Optionally, the width of the cross section is similar to the diameter of wire 260 with a circular cross section. In some embodiments of the invention, wire 260 has a sharpened head which serves as a blade to assist in removing hairs which did not burn from the heat.

Wire 260 has a length, for example, of 25-30 millimeters though it could have a length greater than 30 millimeters or less than 25 millimeters, based upon, for example, the amount of hairs 404 that it is designed to cut on each pass.

Examples of springy electrically conductive materials used in manufacturing posts 240 and/or 242, include spring steel (SS 302) and beryllium copper. Optionally, the posts are plated with a material such as tin, which improves conductivity to the wire and solderability of the posts.

Skin-depressing elements 312 are shown as being straight comb-like pieces, though their shape could vary. Alternatively or additionally, rows of skin-depressing elements 312 with varied designs could be included in a kit provided with unit 100. For example, rows of skin-depressing elements 312 included in the kit could be curved along their length, semi circular or even end in round balls. Use of the various designs of rows of skin depressors 312 could be based on, for example hair density and/or preference of the operator.

Figure 5A:
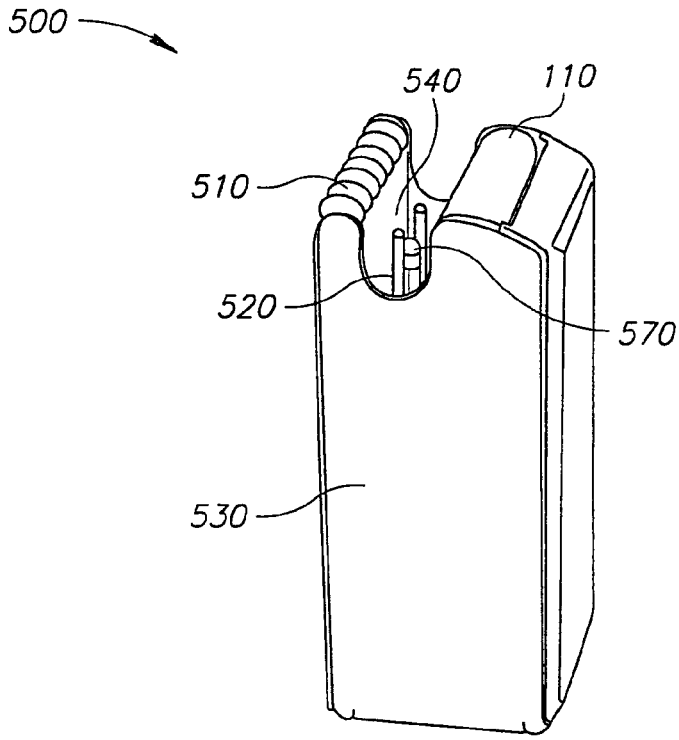
FIG. 5A is a schematic diagram of a hair cutting unit without a shaving head according to an exemplary embodiment of the invention.
Figure 5B:
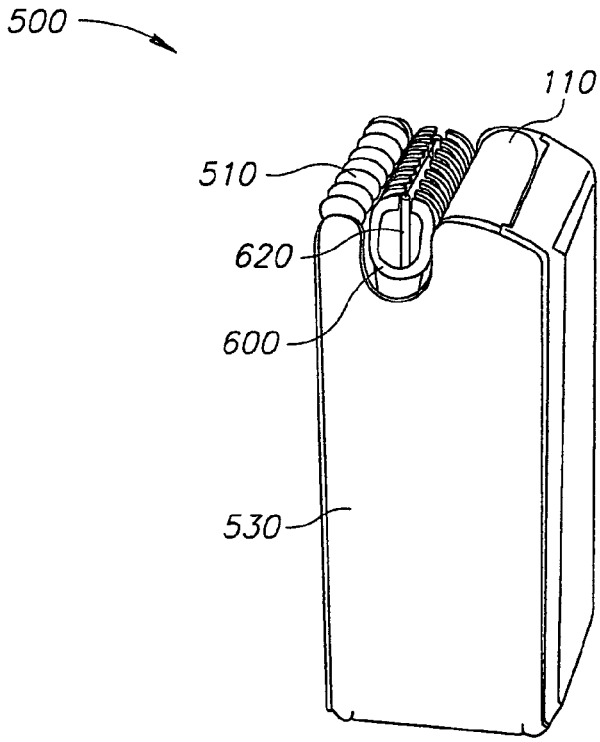
FIG. 5B is a schematic diagram of a hair cutting unit with a removable shaving head deployed to contact the skin, according to an exemplary embodiment of the invention.

FIG. 5A is a schematic diagram of a hair cutting unit 500 without a shaving head according to an exemplary embodiment of the invention. In an exemplary embodiment of the invention, hair cutting unit 500 comprises an encasement 530 with two support elements (510, 110) installed on the top end that interface the user's skin 400. In an exemplary embodiment of the invention, a socket 540 is provided between the two support elements. Optionally, as shown in FIG. 5B a removable shaving head 600 is deployed into socket 540 between the supports in order to cut hair. In an exemplary embodiment of the invention, one of the supports comprises motion detector wheel 110, which senses movement of the head across a surface with hair and activates hair cutting unit 500. Optionally, the second support comprises a balance roller or fingers 510, which balances hair cutting unit 500 so that removable shaving head 600 will be held tangent to the surface of skin 400 while hair cutting unit 500 is pressed against skin 400 to cut hair. Optionally roller or fingers 510 have only a small contact area (in the transverse direction) with skin surface 400, so that the hair can pass freely to the cutting head.

In an exemplary embodiment of the invention, socket 540 comprises two or more conduction posts 520 upon which removable shaving head 600 is mounted. Optionally, conduction posts 520 supply electrical current to shaving head 600 to heat wire 260. Optionally, the posts can be non-conducting with electrical connection to the cutting head provided by other means.

Figure 5C:
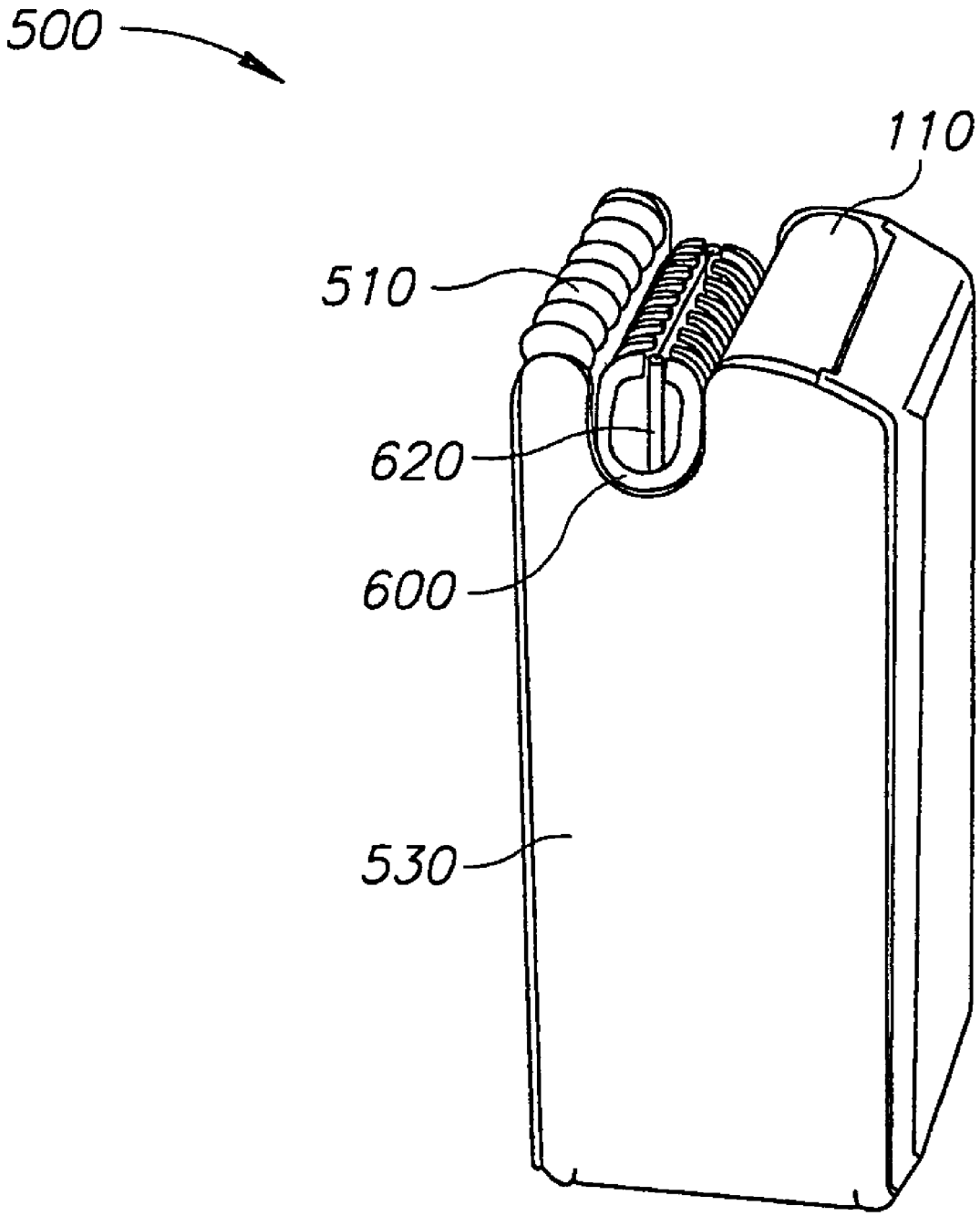
FIG. 5C is a schematic diagram of a hair cutting unit with a removable shaving head deployed at a distance from the skin, according to an exemplary embodiment of the invention.

FIG. 5C shows hair cutting unit 500 with shaving head 600 in a retracted position. As indicated above motion detector wheel 110 is used to detect motion (or other means, for example, an optical motion detector or an inertial motion detector, as known in the art or described in the present inventor's previous PCT publications). When motion is detected, a controller optionally, instructs shaving head 600 to be brought to the position shown in FIG. 5B. When motion is not detected, the shaver head is in the retracted position shown in FIG. 5C.

Figure 6A:
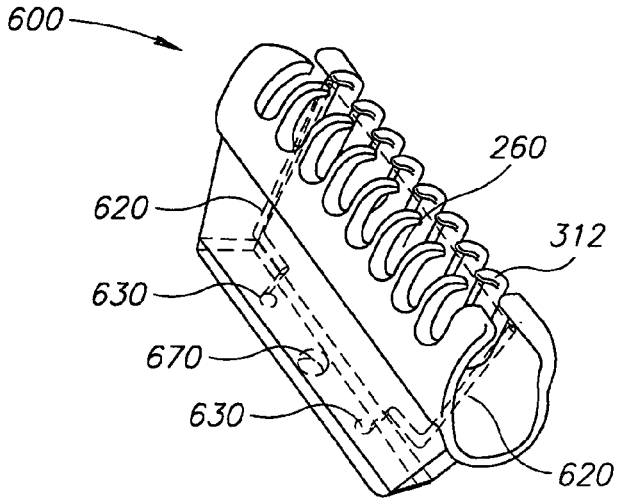
FIG. 6A is a schematic diagram of a removable shaving head, according to an exemplary embodiment of the invention.

FIG. 6A is a schematic diagram of removable shaving head 600, according to an exemplary embodiment of the invention. As shown in FIG. 6A shaving head 600 comprises two or more connection sockets 630 which match conduction posts 520 (shown in FIG. 5A). Optionally, when deployed conduction posts 520 form electrical contact with a connection wire 620 that electrically connects between connection sockets 630 to wire 260.

In some embodiments of the invention, socket 540 and removable shaving head 600 are designed so that removable shaving head 600 is aligned with balance roller 510 and motion detector 110. Optionally, in use of hair cutting unit 500, balance roller 510 and motion detector 110 are pressed against the surface of skin 400 and moved along skin 400 to cut hair. Optionally, motion detector 110 senses the motion and causes hair cutting unit 500 to supply current to heat, wire 260. Skin depressing elements 312 glide along the surface and position the skin surface with respect to wire 260, while the hair is ignited at the point of contact with wire 260. Optionally, when hair cutting unit 500 is not in motion, current is not supplied to wire 260 on order to prevent damage to skin 400 from the heat at the parking position.

In some embodiments of the invention, socket 540 is positioned so that removable shaving head 600 is below the supports (as shown in FIG. 5C), balance roller 510 and motion detector 110. Optionally, when motion detector 110 senses motion socket 540 rises up to align the top of shaving head 600 with balance roller 510 and motion detector 110, in order to cut hair. Optionally, when the motion ceases socket 540 sinks down to the original position which prevents contact between wire 260 and skin 400.

In some embodiments of the invention, current is continuously supplied to wire 260, since skin 400 is protected by withdrawal of head 600, when hair cutting unit 500 is not in motion.

In some embodiments of the invention, the current is turned off, for safety sake. It should be understood that in the shavers described in the inventors' prior publications, the thickness (mass) of the wire is limited by the need to cool the wire quickly when the current is turned off, so that the skin does not burn. However, in accordance with the present embodiment of the invention, a thicker wire 260 (e.g. with a diameter of 100-200 micrometers), can be used as compared with the disclosures, since it is taken out of contact with the skin when there is no motion. In addition, the wire can be heated to a higher temperature, since head 600 withdraws when not in motion along the surface of skin 400, thus preventing any specific position from getting burnt. Alternatively or additionally, current may be supplied to the wire as pulses, which are sufficient to burn hair but are short enough to prevent the skin from getting burnt.

In some embodiments of the invention, a Led hole 670 is created at the bottom of removable head 600 to mount a Led or other light source 570 (shown in FIG. 5A) to illuminate the wire and skin, for example to indicate that hair cutting unit 500 is in use and/or that wire 260 is hot.

In some embodiments of the invention, socket 540 is vibrated during use in order to enhance the cutting process as described above. However, it should be understood that vibration and other particular features of the described embodiments need not be present in an actual embodiment. In general, each of the features of the present invention may be used with prior disclosed embodiments and can be individually implemented without others of the new features described herein.

Figure 6B:
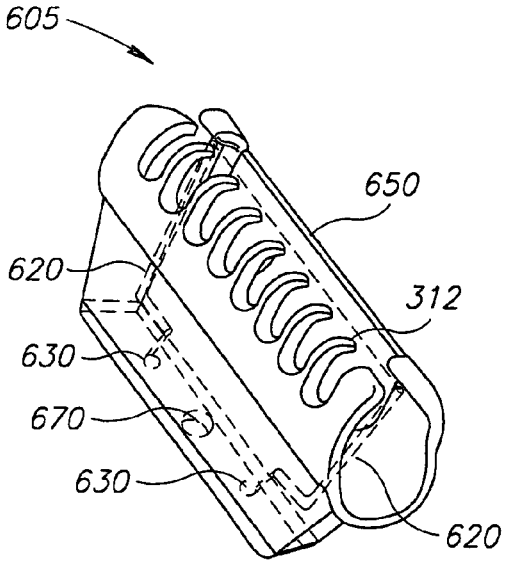
FIG. 6B is a schematic diagram of an alternative removable shaving head, according to an exemplary embodiment of the invention.

FIG. 6B is a schematic diagram of an alternative removable head 605, according to an exemplary embodiment of the invention. In an exemplary embodiment of the invention, the cutting process using a heated wire 260 may leave debris on the skin and/or in the pores of the hairs, for example as a result of igniting the hairs causing carbonization of the base of the hair in the pore and/or around it. In an exemplary embodiment of the invention, a removable head 605 with a debris removal element 650 (such as a preferably blunt scraper) is used during the cutting process to scrape away debris. Optionally, element 650 is positioned in any other position at which it can scrape the skin after the hair is cut. As used herein, the term "blunt" element means that the element is incapable of cutting hair.

Figure 6C:
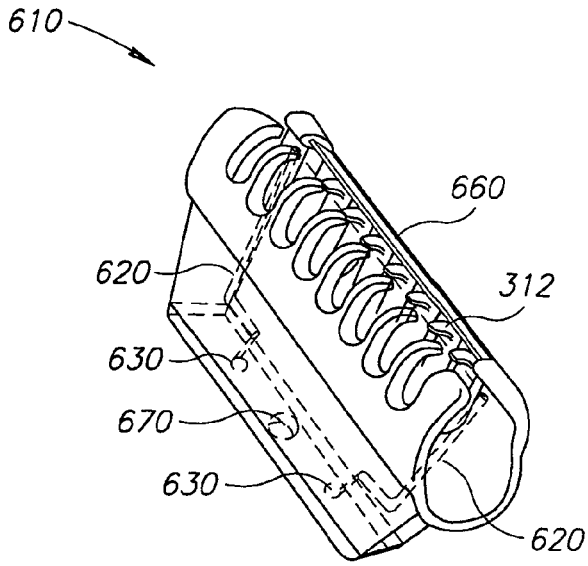
FIG. 6C is a schematic diagram of an additional alternative removable shaving head, according to an exemplary embodiment of the invention.

FIG. 6C is schematic diagram of an additional alternative removable head 610, according to an exemplary embodiment of the invention. In this embodiment of the invention, a removable head 610 with a blade 660 is used in order to cut the hair after wire 260 has heated it and enhance the speed of the cutting process. Depending on the wire temperature and mass, wire 260 can cut all or some of the hair, with blade 660 completing the process. Alternatively, for lower temperature of the wire, the hair is not cut through by the wire. However, the heat from wire 260 prepares the hair for cutting (e.g., it softens the hair) so that it is more easily cut. Unlike the prior art device described in the background of the invention, the heated wire can be hot enough to heat the hair to a temperature substantially higher than a temperature that would damage the skin, due to one or more of the low mass of the wire, pulsing of the wire, heating of the wire only when motion is detected and/or the removal of the wire from skin contact when motion is not detected. In some embodiments of the invention, wire 260 may reach temperatures higher than 50° C., 100° C., 150° C. or even as high as 1000° C.

A variety of numerical indicators have been utilized to describe the dimensions or temperature of the heat-generating wire. Additionally, a variety of numerical indicators have been utilized to describe structures besides heat-generating wire, including length, diameter and position of skin depressors in relation to the heat-generating wires. It should be understood that these numerical indicators could vary even further based upon a variety of engineering principles, materials, intended use and designs incorporated into the invention. The reader is further referred to the above referenced PCT applications, which contain numerous variations on many of the features described herein.

It should be further understood that the individual features described herein can be used together, in the manner above, in a single shaving device. Alternatively, each of the features (or some combination of them) can be used separately, for example, by being added to one of the devices shown in the above referenced PCT publications. Furthermore, it should be understood that the examples given above are exemplary in nature and are not intended to limit the scope of the invention or the claims.

The terms "include", "comprise" and "have" and their conjugates as used herein mean "including but not necessarily limited to".

The invention claimed is:

1. A hair cutting head, for use in a hair cutting apparatus comprising:

an elongated heated wire suitable for heating hair growing from a skin surface; when situated at a first position at which the skin would be damaged if the wire is stationary, and at least one blade, placed at one side of the elongated heated wire, the at least one blade being situated and configured to cut the hair which has been heated by the elongated heated wire; and a motion detector adapted to detect motion of the hair cutting head on the skin surface, wherein the elongated heated wire is heated to a temperature of at least 50° C., and wherein burning of the skin surface is prevented due to heating the elongated heated wire by motion of the wire, when motion is detected by said motion detector and wherein the elongated heated wire is displaced from the first position to a second position at which the skin is not damaged when motion is not detected by said motion detector.

2. A hair cutting head according to claim 1, comprising a row of skin depressing elements on at least one side of the elongated heated wire.

3. A hair cutting head according to claim 1, comprising a row of skin depressing elements on both sides of the elongated heated wire.

4. A hair cutting head according to claim 1, wherein said elongated heated wire has a diameter between 10 to 1000 micrometers.

5. A hair cutting device comprising:

a hair cutting head according to claim 1, wherein said elongated heated wire is heated when said elongated wire is in the first position.

6. A hair cutting device according to claim 5, wherein said elongated heated wire is heated to a temperature higher than 100° C.

7. A hair cutting device according to claim 6, wherein said elongated heated wire is heated to a temperature higher than 150° C.

8. A hair cutting device according to claim 6, wherein said elongated heated wire is heated to a temperature higher than 250° C.

9. A hair cutting device according to claim 6, wherein said elongated heated wire is heated to a temperature higher than 350° C.

10. A hair cutting device according to claim 6, wherein said elongated heated wire is heated to a temperature higher than 500° C.

11. A hair cutting device according to claim 6, wherein said elongated heated wire is heated to a temperature higher than 700° C.

12. A hair cutting device according to claim 5, wherein said elongated heated wire is heated to a temperature high enough so that it cuts at least some of the hair before the hair comes into contact with said blade, when the elongated heated wire and blade are drawn across the skin.

13. A hair cutting head according to claim 2, wherein said elongate wire has a diameter between 10 to 1000 micrometers.

14. A hair cutting head according to claim 3, wherein said elongate wire has a diameter between 10 to 1000 micrometers.

15. A hair cutting head according to claim 2, wherein said elongate wire is heated when said cutting head comes in contact with a skin surface.

16. A hair cutting head according to claim 3, wherein said elongate wire is heated when said cutting head comes in contact with a skin surface.

17. A method of cutting hair growing from the skin, comprising:

heating a portion of a hair attached to the skin of a person to a temperature above 50° C. by contacting the portion with an elongate wire heated above 50° C., situated at a first position at which it would damage the skin if it is stationary;

cutting the hair at the heated portion with a blade; and detecting motion of the elongate wire with respect to the skin surface, wherein burning of the skin surface is prevented due to heating the elongate wire only when motion is detected by moving the elongate wire from said first position to a second position further from the skin surface, when motion is not detected.

18. A method according to claim 17 wherein heating a portion of a hair comprises heating by contacting the portion with an elongate wire heated to a temperature higher than 100° C.

19. A method according to claim 17 wherein heating a portion of a hair comprises heating by contacting the portion with an elongate wire heated to a temperature higher than 150° C.

20. A method according to claim 17 wherein heating a portion of a hair comprises heating by contacting the portion with an elongate wire heated to a temperature higher than 250° C.

21. A method according to claim 17 wherein heating a portion of a hair comprises heating by contacting the portion with an elongate wire heated to a temperature higher than 350° C.

22. A method according to claim 17 wherein heating a portion of a hair comprises heating by contacting the portion with an elongate wire heated to a temperature higher than 500° C.

23. A method according to claim 17 wherein heating a portion of a hair comprises heating by contacting the portion with an elongate wire heated to a temperature higher than 700° C.

24. A method according to claim 17 and including juxtaposing the elongate wire and the blade in a generally parallel configuration.

25. A method according to claim 24 wherein the method includes first moving the elongate wire and then the blade across the skin.

26. A method according to claim 25 wherein at least some of the hair growing from the skin is not cut by the elongate wire as it passes across the skin.

27. A method according to claim 25 wherein heating a portion of a hair comprises heating by contacting the portion with an elongate wire not hot enough to cut the hair.

* * * * *